United States Patent [19]

Stahlecker

[11] 4,047,371

[45] Sept. 13, 1977

[54] SPINNING MACHINE FACILITY WITH A PLURALITY OF OPEN END SPINNING MACHINES AND AT LEAST ONE SERVICING INSTRUMENT

[75] Inventor: Fritz Stahlecker, Bad Uberkingen, Germany

[73] Assignees: Hans Stahlecker; Fritz Stahlecker, both of Germany

[21] Appl. No.: 737,265

[22] Filed: Nov. 1, 1976

Related U.S. Application Data

[63] Continuation-in-part of Ser. No. 732,880, Oct. 15, 1976.

[30] Foreign Application Priority Data

Dec. 13, 1975 Germany ..... 2556237

[51] Int. Cl.[2] ..... D01H 15/00; D01H 11/00; D01H 13/14; D01H 1/12

[52] U.S. Cl. ..... 57/34 R; 57/56; 57/58.95

[58] Field of Search ..... 57/34 R, 58.89–58.95, 57/52, 53, 54, 56, 78, 80, 81

[56] References Cited

U.S. PATENT DOCUMENTS

| | | | |
|---|---|---|---|
| 3,680,299 | 8/1972 | Lee | 57/34 R |
| 3,740,937 | 6/1973 | Drake | 57/34 R |
| 3,858,385 | 1/1975 | Shinkai et al. | 57/34 R |
| 3,950,926 | 4/1976 | Stahlecker | 57/34 R |
| 3,988,879 | 11/1976 | Franzolini et al. | 57/34 R |
| 4,007,457 | 2/1977 | Aepplii | 57/81 X |

*Primary Examiner*—Donald Watkins
*Attorney, Agent, or Firm*—Craig & Antonelli

[57] ABSTRACT

Servicing apparatus, such as rotor cleaning and yarn piecing apparatus, for servicing individual spinning assemblies of open-end spinning machines is provided. In order to accommodate usage of a single servicing instrument for several different spinning machines, operating at different conditions for producing different yarns, program control apparatus, including a plurality of control programs which are distinguished from one another as the sequence and timing of servicing operations, is provided. In preferred embodiments, the spinning machines include switch setting apparatus for switching the servicing instrument to the proper program in response to movement of the servicing instrument adjacent the spinning machine to be serviced.

11 Claims, 5 Drawing Figures

SPINNING MACHINE FACILITY WITH A PLURALITY OF OPEN END SPINNING MACHINES AND AT LEAST ONE SERVICING INSTRUMENT

This application is a continuation-in-part application of my copending application Ser. No. 732,880 filed Oct. 15, 1976, and titled "Movable Servicing Device for a Spinning Machine, Especially an Open End Spinning Machine".

The invention relates to servicing apparatus for a spinning machine facility with a plurality of open end spinning machines, which servicing apparatus includes at least one movable servicing means for performing servicing operations at respective spinning assemblies of the spinning machine and a program switch with which the sequences and times of switching of the drive of the function elements of the servicing means are controlled, the said function elements executing the individual steps of a servicing operation. Since the above-mentioned copending application also relates to servicing apparatus of the type which this invention is also concerned, the contents of said copending application are hereby incorporated herein by reference thereto to the extent necessary for a complete understanding of the present invention.

To improve the piecing of a yarn in open end spinning assemblies, mobile servicing assemblies are known that work automatically. In a known construction (German OS No. 2,350,840) the individual spinning assemblies are monitored for operational disturbances, especially for the presence of yarn breaks. If the servicing instrument detects an operational disturbance, it hals at the disturbed spinning assembly and starts the necessary piecing program, after which the individual function elements are actuated, as a whole executing the servicing operation in question. Since in most cases the cause of a yarn break is the presence of soiling, especially soiling of the spinning rotor, it is advantageous if the actual piecing process is preceded by another servicing operation, namely a cleaning process as this is done in the known construction. The necessary function elements can be combined to form a special servicing unit which can function automatically. The servicing units for cleaning and piecing can travel together, or separately.

In order to be able to economically use the servicing instrument, it is advantageous if a plurality of open end spinning machines are combined as one spinning machine facility, which spinning machines are all serviced by the common servicing instrument/instruments. This means that the travel tracks of the individual open end spinning machines that are assigned for the servicing instrument/instruments are interconnected so that the servicing instrument/instruments can travel to all open end spinning machines.

Since a great advantage of open end spinning machines is tht they can be adjusted in such a way that different types of yarn can be spun with them, it is to be anticipated that inside a spinning machine facility, two or more different kinds of yarn can be spun out. This circumstance involves difficulties for travelling servicing instruments, especially those that execute piecing operations, because these instruments have to take into account different working conditions in piecing, to be able to perform the piecing operations successfully.

The present invention is addressed to the problem of developing the servicing instrument/instruments for a spinning machine facility of the mentioned type so that with the same servicing instrument, servicing opertions on the open end spinning machines can be performed selectively under different spinning conditions, e.g. the spinning of different kinds of yarns. The invention contemplates providing that a number of switching sequences and/or switching times for different servicing programs, independently of the operating conditions of the open end spinning machine in question which is to be serviced, are connected with the program switch.

In this way the same servicing instrument can be used with very different working conditions, since it is adapted to these working conditions or to the spinning machine respectively. There is no need to manage conversions or equipping times.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
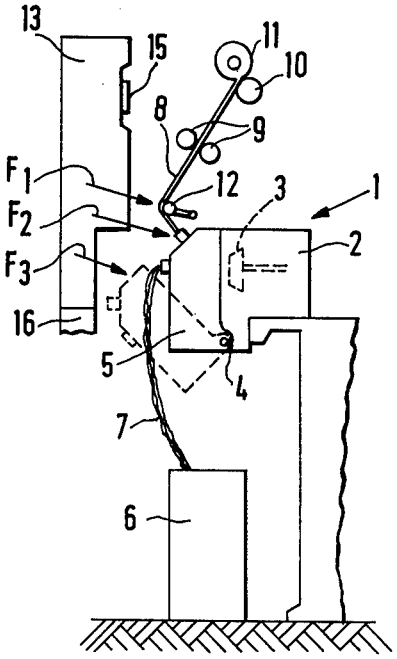
FIG. 1 is a schematic cross-sectional view of an open end spinning machine with a mobile servicing instrument according to the present invention.
Figure 2:
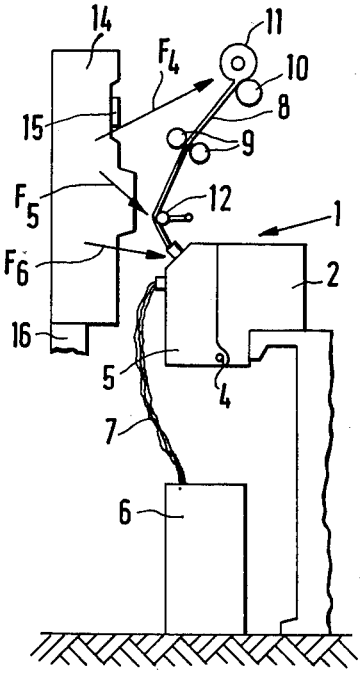
FIG. 2 is a further schematic cross-sectional view of the open end spinning machine of FIG. 1, with a further servicing instrument according to the present invention.

The open end spinning machine which is schematically shown in FIGS. 1 and 2 comprises a plurality of spinning assemblies 1 that are arranged side by side. In the illustrated embodiment the respective spinning assemblies 1 have a housing part 2 in which the spinning rotor 3 indicated by dashed lines in FIG. 1 is disposed. In a housing part 5 that is pivotable about a shaft 4, there are the necessary delivery and opening means. A sliver 7 taken from a can 6 is delivered to the delivery (feed) and opener device disposed in housing part 5, in which it is opened to form individual fibers and is conveyed to spinning rotor 3. In spinning rotor 3 the fibrous material is joined as a yarn 8 that is pulled off by roll 9 and by means of a winding roll 10 it is wound on a spool 11. The presence of yarn is monitored by yarn monitor 12. As FIG. 1 also indicates, housing part 5 can be swung about its shaft 4 in such a way that spinning rotor 3 is accessible for cleaning.

A mobile servicing instrument or device is associated with the open end spinning machine. In the illustrated embodiment the servicing instrument is constituted by two combined or independently travelling part instruments 13 and 14 that are respectively capable of being put into operation, to perform a work process. Part instrument 13 of the servicing instrument effects the cleaning of open end spinning assembly 1, for instance, especially the cleaning of spinning rotor 3. For this the said part instrument 13 has a plurality of function elements that are indicated by arrows $F_1$, $F_2$ and $F_3$ which perform the individual steps of the servicing operation. Function element $F_1$ interrupts yarn delivery by actuating the yarn sensor 12, function element $F_3$ then swings housing part 5 down, and function element $F_2$ then cleans spinning rotor 3. Function element $F_1$ only goes into action if a yarn break is deliberately produced, which will be explained below. In a preferred embodiment there would advantageously be still other function elements, especially those that clean an opener roll or that suck out dirt or the like (not illustrated). Embodiments are also contemplated where the cleaning is done without swinging down housing part 5.

The second part instrument 14 then includes function elements which effect the actual piecing operation after the cleaning. For this there is a function element $F_4$ that lifts winding roll 10 from spool 11 for the piecing process, seeks the yarn end and then winds it off against the normal winding direction. The yarn end is then advantageously prepared inside instrument 14 and carried back via a function element $F_5$ against the normal delivery direction in spinning rotor 3, there to be applied against a sliver ring and again drawn off. Advantageously other function elements are provided, e.g. function element $F_6$ that controls feed of the sliver during piecing. Part instruments 13 and 14 are equipped with detectors 15 that can receive signals from signalling devices (not illustrated) associated with the respective spinning assemblies 1 and indicating their need for servicing. This signalling is advantageously controlled by yarn monitor 12 which, when there is a yarn break, interrupts the feed of sliver 7 and triggers the signal that is to be received by detectors 15. Detectors 15 and the appurtenant signalling devices can be constructed according to the invention to function mechanically, optically, acoustically, or electrically. On receiving a signal that a spinning assembly 1 requires attention, detector 15 starts a program switch with which halting and aligning of instruments 13 and 14 and the subsequent servicing operations are controlled. The described detectors 15 manage also those cases in which the individual spinning assemblies are equipped with instruments that effect a control of the spun yarn and that stop spinning assembly 1 as soon as the yarn no longer has the prescribed quality.

With part instruments 13 and 14 there can also be a so-called preventive cleaning, for which the said part instruments are equipped with a step switch that is connected ahead of the program switch and that ensures, whether or not there is a yarn break, that part instruments 13 and 14 will be associated with a spinning assembly and execute a servicing operation there. More details of the apparatus are included in the above-mentioned copending application.

Figure 4:
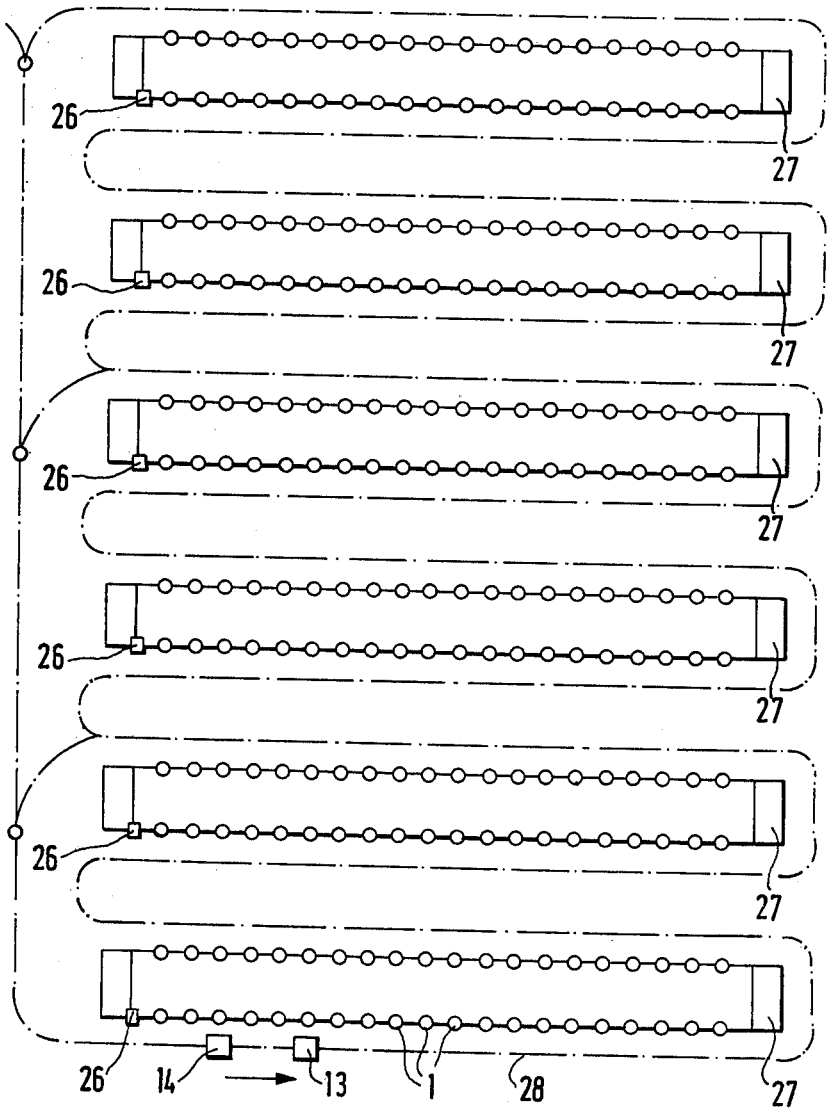
FIG. 4 is a top schematic view of a spinning machine facility arranged according to the present invention.

As shown in FIG. 4, it is advantageous and customary in practice, to have a plurality of open end spinning machines 27 combined to form one spinning machine facility, interconnected via a track 28 for the two part servicing instruments 13, 14, so that part instruments 13 and 14 may be selectively associated with all spinning assemblies 1 of the individual open end spinning machines 27. It is to be anticipated in practice that not all open end spinning machines of a facility will have the same working conditions, but rather that different materials will be processed on the individual open end spinning machines, and also that yarns with different deniers will be produced. In this case the individual open end spinning machines are distinguished from one another in their operating conditions, even if otherwise they are indentically designed. These different operating conditions include the rpm of the spinning rotor, the sliver feed rate, and the yarn draw off speed etc. There may also be differences as to rotor form, especially rotor diameter for the different spinning machines of the facility. These different operating conditions have an effect on the functioning of part instrument 14 that performs the actual piecing operation, because this part instrument 14 cooperates with the running elements of the spinning assembly. Operation of part instrument 14 is dependent upon the rotor rpm, at which instant the yarn will be applied to the sliver in the spinning rotor and again drawn off. The supply of fiber material, controlled or taken over by the servicing instrument during piecing must also be adapted to. Operation of part instrument 14 is also in part dependent upon the rotor diameter, with which length of yarn has to be taken back to the rotor, so that it will reach the sliver there. In addition, still other function elements may be affected by the different working conditions of the individual open end spinning machines; especially those elements that prepare the yarn end for piecing in a special way, because at least in part this preparation depends upon the type of yarn. From the above statements it can be understood that the same servicing instrument that executes the piecing process, i.e. part instrument 14 in the illustrated embodiment, is not able simply to service open end machines that have different working conditions and that, for example, produce yarns with different deniers. For part instrument 13 on the contrary the different working conditions of the individual open end spinning machines play practically no part because these servicing operations are not done in conjunction with the actual spinning.

Figure 3:
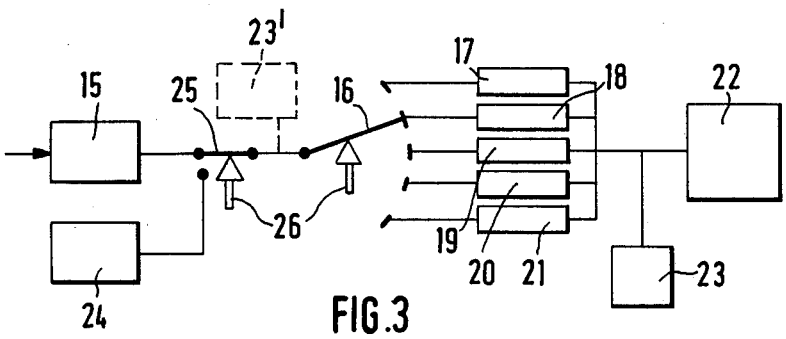
FIG. 3 is a schematic block diagram depicting control appartus for a servicing instrument according to a preferred embodiment of the present invention.

The switching times and succession of function elements $F_4$, $F_5$ and $F_6$ of part instrument 14 as well as possibly other supplementary function elements in this part instrument 14 are determined by a program switch. Since the individual open end spinning machines are distinguished only by their working conditions and not by their basic structure, it suffices if the program switch be arranged to adapt the servicing instrument to the open end spinning machine in question. To avoid the need for adjustments or conversions, it is provided that the program switch schematically shown in FIG. 3 be provided with a plurality of programs 17 to 21 that come selectively into operation as a function of the working conditions of the open end spinning machine. Detector 15 that responds to disturbances of the individual spinning assemblies is connected via a selector switch 16 with one of the respective programs 17 to 21, that in turn are connected to drive 22 of the function elements and to drive 23 of the travelling device. Programs 17 to 21 are so designed that the work steps that they control are adapted to the various working conditions of the open end spinning machines. Insofar as there is a question of open end spinning machines of the same type, in which the individual spinning assemblies are arranged in equal division, drive 23' of the travelling device can be directly controlled by the detector signal, as indicated by dashed lines in FIG. 3. If drive 23 is controlled via programs 17 to 21, it is possible to take different machine divisions into account with these programs.

Between detector 15 and selector switch 16 and programs 17 to 21 respectively there is also a double throw switch 25 that can be switched over to a step switch 24 which gives a signal corresponding to the signal of detector 15. By means of this step switch it is possible to move the servicing instrument stepwise from spinning assembly to spinning assembly, or also to move it in jumps of a multiple of machine divisions, and to associate it to the spinning assemblies and there perform servicing operations without the occurrence of a yarn break or other disturance (preventive maintenance operation). If the servicing instrument consists of two part instruments 13 and 14, that are independently mobile, i.e. that have their own travelling devices, it suffices to have such a step switch 24 on part instrument 13 that travels ahead, executing the cleaning and preparatory servicing operations, because then said part instrument 13 artificially creates a disturbance of the spinning assembly by means of its function element $F_1$ so that the following part instrument 14 in this case finds a disturbed spinning assembly to which detector 15 responds.

It is also contemplated that selector switch 16 and also double throw switch 25 could be manually actuated by the servicing personnel. For example, it is possible to provide a check at the entrance of each open end spinning machine past which the servicing instrument can move only if the servicing operator releases it and checks the program, and possibly establishes a special program by means of selector switch 16. In practice though it is advantageous if this checking and preferably the required setting is automatic. As FIG. 4 shows, it is advantageous for this to have a switch element 26 in the region of the entrance of track 28 to the respective spinning machines 27, that will emit a characterizing signal for the working conditions of the open end spinning machine 27 in question. By means of this signal the setting of selector switch 16 of the passing servicing instrument is checked and corrected if need be. Switch elements 26 may be supplied also with additional information that gives data as to the operating state of the open end spinning assembly in question and, for example, by then signalling to the double throw switch 25 that is also passing by, switch over to step switch 24, if a general need for servicing of machine 27 in question is established. This can be controlled for example by a timing switch that determines the length of operation since the previous cleaning, by a counter that counts the passage of the servicing instruments, or by a device that counts the number of yarn breaks or other disturbance of the open end spinning machine within a given period. In preferred contemplated arrangements, a combination of these data can also be utilized.

Switching element 26 checks and actuates the correspondingly designed selector switch 16 and/or double throw switch 25 mechanically, pneumatically, optically or electrically. If mechanical actuation is provided, then for example it is sufficient to have movable cams as switching elements 26 for selector switch 16, associated with key-like switching elements of selector switch 16 that passes by with the servicing instrument. If for example program 17 is determined for a 16 denier yarn, then it suffices to apply the cam to the marking provided or this on open end spinning machine 27 in question or to set it on the marking. The cam then actuates the key-like switch element of selector switch 16 that is associated with it, when the servicing instrument with selector switch 16 passes the cam, whereby selector switch 16 is switched over to program 17 in question, insofar as this program has not already been preset.

Figure 5:
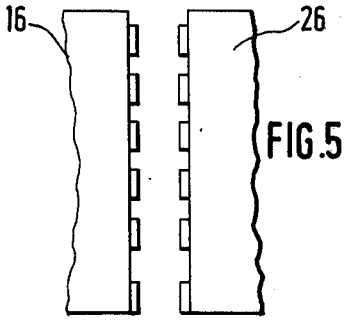
FIG. 5 is a schematic enlarged part view of a selector switch and a switch element constructed in accordance with the present invention.

In FIG. 5, a selector switch 26 is illustrated, which has photocells at specific places, to check and possibly change the switch position when they receive a light signal. Light signals in this case are emitted by switch element 26 equipped with light sources corresponding to the defined places that are coordinated with the photocells.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Servicing apparatus for a plurality of spinning machines comprising:

servicing means for servicing spinning assemblies of the spinning machines, said servicing means including function elements for carrying out servicing operations, moving means for moving said servicing means to respective servicing positions adjacent the respective spinning assemblies to be serviced, program control means for controlling switching sequences and switching times of drives for said function elements, said program control means including a plurality of control programs which are distinguished from one another as to switching sequence and/or switching times, whereby different spinning machine operating conditions can be accommodated by said servicing means, and program switch control means for switching said program control means from one control program to another.

2. Servicing apparatus according to claim 1, wherein said program switch control means includes means for switching said program control means in dependence on the operating conditions of the spinning machine of the spinning assembly to be serviced.

3. Servicing apparatus according to claim 2, wherein said program switch control means includes a selector switch at the servicing means for setting a program appropriate to the spinning machine to be serviced.

4. Servicing apparatus according to claim 3, wherein each spinning machine is provided with a switching element that sets the selector switch in accordance with the operating condition of the spinning machine.

5. Servicing apparatus according to claim 4, wherein each spinning machine in the region of an entrance for the servicing means has one of said switching elements for setting the selector switch of a passing servicing means.

6. Servicing apparatus according to claim 5, wherein said switching element includes one of mechanical, optical, acoustical, pneumatic, and electrical means for transmitting a signal to the selector switch.

7. Servicing apparatus according to claim 1, further comprising:

disturbance responsive control means for controlling said moving means to move said servicing means to move said servicing means to a service position adjacent a spinning assembly in response to detection of an operational disturbance at said spinning assembly, whereby those spinning assemblies exhibiting an operational disturbance can be serviced, step-by-step control means for controlling said moving means to move said servicing means to respective servicing positions adjacent respective spinning assemblies in a predetermined sequence, where preventive maintenance servicing operations can be carried out by said servicing means, and switchover means for switching control of said moving means between said disturbance responsive control means and said step-by-step control means.

8. Servicing apparatus according to claim 7, wherein said switchover means includes:

travel path responsive means for switching to said step-by-step control means in response to traversal of a predetermined travel path by said servicing means, and time responsive means for switching to said disturbance responsive control means after a predetermined time interval.

9. Servicing apparatus according to claim 2, wherein said spinning assemblies are open end spinning assemblies, and wherein said servicing means includes yarn piecing means for performing yarn piecing operations at said spinning assemblies.

10. Servicing apparatus according to claim 7, wherein said switchover means includes a double throw switch for switching between said disturbance responsive control means and said step-by-step control means.

11. Servicing apparatus according to claim 2, wherein a common interconnected guide track is provided for accommodating travel of said servicing means adjacent a plurality of separately drivable open end spinning machines, each of said spinning machines including a plurality of open end spinning assemblies, and wherein said servicing means includes means for performing a thread piecing operation.

* * * * *